US007269964B2

(12) United States Patent
Hand

(10) Patent No.: US 7,269,964 B2
(45) Date of Patent: Sep. 18, 2007

(54) EVAPORATOR AND ASSOCIATED FOOD PAN REFRIGERATOR WITH AN ANGLED FAN HOUSING

(76) Inventor: Michael S. Hand, 251 Lakeview Dr., Baldwin, GA (US) 30511-2711

( * ) Notice: Subject to any disclaimer, the term of this patent is extended or adjusted under 35 U.S.C. 154(b) by 244 days.

(21) Appl. No.: 11/159,963

(22) Filed: Jun. 23, 2005

(65) Prior Publication Data

US 2006/0288723 A1 Dec. 28, 2006

(51) Int. Cl.
*F25D 23/12* (2006.01)

(52) U.S. Cl. ..... 62/258; 62/426

(58) Field of Classification Search ..... 62/258, 62/426–427; 165/122
See application file for complete search history.

(56) References Cited

U.S. PATENT DOCUMENTS 2,798,366 A * 7/1957 Erl ..... 62/285
4,802,340 A * 2/1989 Johnson ..... 62/229
5,191,769 A * 3/1993 Mangini et al. ..... 62/258
5,249,435 A 10/1993 Lever et al.
5,259,206 A * 11/1993 Dankowski ..... 62/507
5,277,039 A 1/1994 Haasis
6,450,251 B1 * 9/2002 Lin et al. ..... 165/122
6,564,569 B1 * 5/2003 Havens ..... 62/258
6,612,124 B1 * 9/2003 Hatch et al. ..... 62/258
7,219,508 B2 * 5/2007 Durbin ..... 62/257
2005/0204765 A1 9/2005 Durbin

FOREIGN PATENT DOCUMENTS

CA 1 312 734 C 1/1993

* cited by examiner

*Primary Examiner*—William E. Tapolcai
(74) *Attorney, Agent, or Firm*—Michael J. Mehrman; Mehrman Law Office P.C.

(57) ABSTRACT

An evaporator and associated food pan refrigerator, such as sandwich-top refrigerators and those used for salads, seafood, ice cream, condiments, and so forth. The food pan refrigerator includes a number of food pans set into the top surface of the refrigerator. The angled fan housing blows the refrigerated air exiting the evaporator evenly across the bottom of the food pans, resulting in even cooling of all pans. In addition, the angled fans effectively and efficiently circulate the air from the fans to the warmest section in the front of the refrigerator and then to the air return located at the bottom of the evaporator. The result is an improved evaporator and associated food pan refrigerator that cools the food pans more evenly and efficiently than prior food pan refrigerators.

4 Claims, 2 Drawing Sheets

EVAPORATOR AND ASSOCIATED FOOD PAN REFRIGERATOR WITH AN ANGLED FAN HOUSING

TECHNICAL FIELD

The present invention relates to the field of food pan refrigerators, such as sandwich-top refrigerators and pizza make tables used in various restaurants. More particularly, this invention relates to an evaporator for an food pan refrigerator that has an angled fan housing to better cool the ingredient pans.

BACKGROUND OF THE INVENTION

Food pan refrigerators used in restaurants include a refrigerator with a number of ingredient pans set into the top surface of the refrigerator chest. In sandwich restaurants, these units are commonly known as "sandwich-top refrigerators," in pizza restaurants they are known as "pizza make stations," and similar units are used for buffets, salad bars, ice cream sundae bars, seafood, condiments, and so forth. An evaporator inside the food pan refrigerator is intended to cool the food pans evenly without freezing the ingredients in the pans. Conventional evaporators, however, are not well suited to this task because they blow the refrigerated air either straight up or straight out. Blowing the refrigerated air straight up overcools the rearmost pans while under-cooling the forward pans, which can lead to freezing the condiments in the rear pans or allowing the condiments in the forward pans to spoil. Blowing the refrigerated air straight out, on the other hand, may also fail to cool the pans evenly and, in general, is an inefficient way to cool the pans. Accordingly, there is an ongoing need for an improved evaporator and associated food pan refrigerator. In particular, there is a need for an evaporator that cools the food pans set into the top surface of the refrigerator chest evenly and efficiently.

SUMMARY OF THE INVENTION

The present invention meets the needs described above in an evaporator and associated refrigerator, such as a food pan refrigerator used for sandwiches, pizzas salads, buffets, seafood, ice cream, condiments, and so forth. The food pan refrigerator includes a number of food pans set into the top surface of the refrigerator chest. The angled fan housing blows the cooled air exiting the evaporator across the bottom of the food pans, resulting in even cooling of all pans. In addition, the angled fans direct the air flow into the space immediately below the food pans, which is often just above a drawer or shelf, and from the back toward the toward the front of the refrigerator chest. This circulates the air from the fans to the warmest section near the front of the refrigerator and then to the air return located at the bottom of the evaporator. This improved air circulation results in more effective and efficient refrigeration, and also allows greater volume of air to be circulated through the refrigerator. The result is an improved evaporator and associated food pan refrigerator that cools the food pans more evenly and efficiently than prior food pan refrigerators.

Generally described, the invention may be embodied in an evaporator for an food pan refrigerator. The evaporator includes an evaporator cabinet having an angled fan housing supporting one or more fans that are positioned at an angle to the pans set into the top of the refrigerator. The evaporator also includes one or more refrigeration units that deliver cooled air to the fans. As a result of the angled housing supporting the fans, the cooled air exiting the fans is directed to flow across the interior of the top surface of the refrigerator, thereby cooling the food pans set into the surface evenly and efficiently. For example, the evaporator may include three fans and three refrigeration units. Of course, these numbers are merely illustrative, and the invention may be implemented in an evaporator with any numbers of fans or evaporators. The invention may also be embodied in a food pan refrigerator including one or more evaporators as described above.

The specific techniques and structures for implementing particular embodiments of the evaporator and associated food pan refrigerator, and thereby accomplishing the advantages described above, will become apparent from the following detailed description of the embodiments and the appended drawings and claims.

DETAILED DESCRIPTION OF THE EMBODIMENTS

Figure 1:
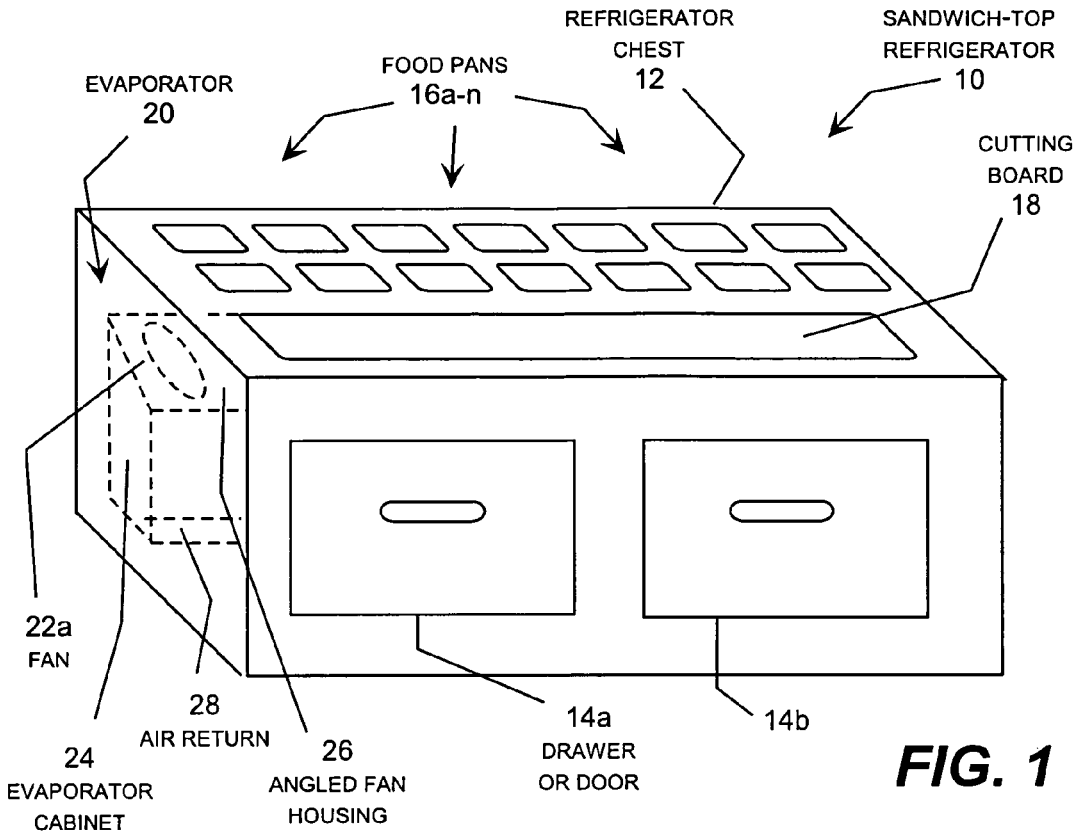
FIG. 1 is a perspective view of a sandwich-top refrigerator having an evaporator with an angled fan housing.
Figure 2:
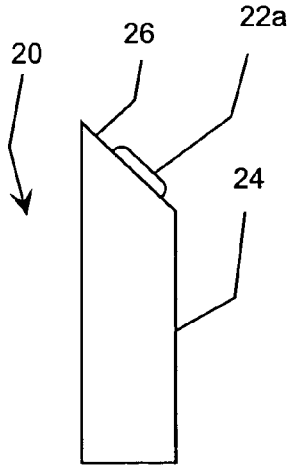
FIG. 2 is a side view of the evaporator with the angled fan housing.
Figure 3:
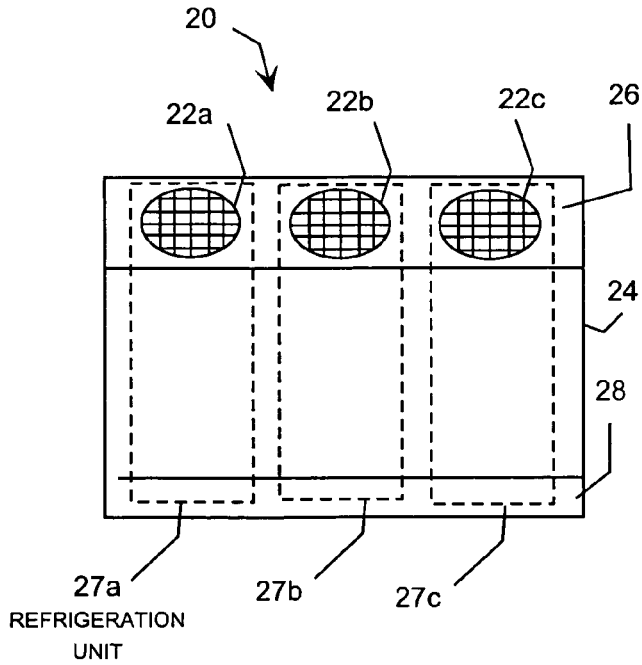
FIG. 3 is a front view of the evaporator with the angled fan housing.

FIG. 1 is a perspective view of an illustrative food pan refrigerator, in this example a sandwich-top refrigerator 10 that includes a refrigerator chest 12, two drawers 14*a-b*, a number of food pans 16*a-n* set into the top surface of the refrigerator chest, and an evaporator 20 located on the inside of the refrigerator chest. The food pans in this particular refrigerator include a row of rearward and a row of forward pans, although other types of food pan refrigerator, such as those used for salad bars or other applications, may include a different configuration of food pans. FIG. 2 is a side view and FIG. 3 is a front view of the evaporator 20.

Figure 4:
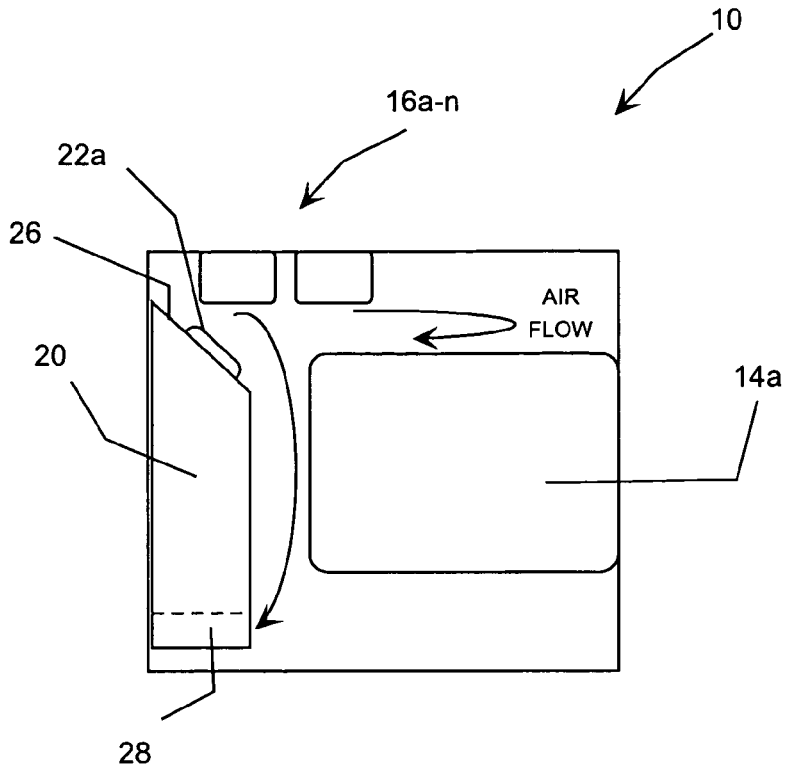
FIG. 4 is a side view of the sandwich-top refrigerator illustrating the air flow created by the evaporator with the angled fan housing.
Figure 5:
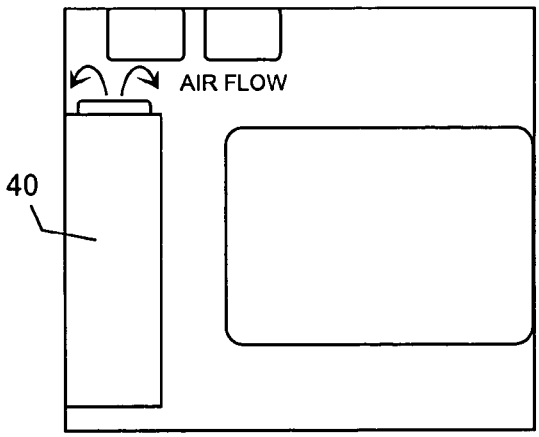
FIG. 5 (prior art)
FIG. 5 is a side view of a sandwich-top refrigerator illustrating the air flow created by a prior art evaporator with that blows the refrigerated air straight up.
Figure 6:
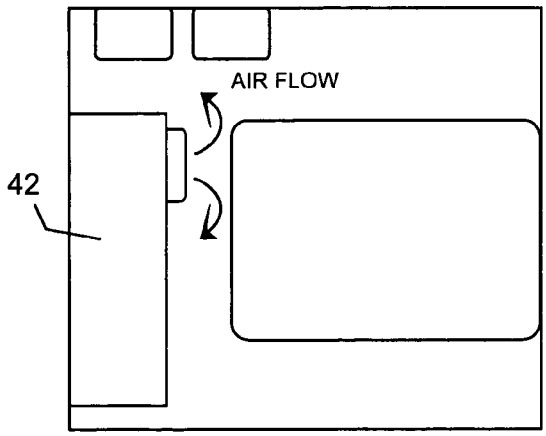
FIG. 6 (prior art)
FIG. 6 is a side view of a sandwich-top refrigerator illustrating the air flow created by a prior art evaporator that blows the refrigerated air straight out.

The drawers 14*a-b* may be replaced by or used in combination with doors, shelves, internal bins or other features of the refrigerator 10 as suited for the particular application. This particular evaporator 20 includes an evaporator cabinet 22 with an angled fan housing 24 that supports three fans 26*a-c*. These fan expel refrigerated air from associated refrigeration units 27*a-c* located inside the evaporator cabinet. The angle of the fan housing, typically in the range of 30° to 60° from horizontal, and its position just below the bottom of the food pans 14*a*, results in an even flow of refrigerated air across the rearward and forward pans, as shown in FIG. 4. In addition, the angled fan housing directs the air flow into the space immediately below the food pans 16*a-b* and above the drawers 14*a-b*. This allows the cooled air to be directed from the back toward the toward the front of the refrigerator chest and circulates the air from the fans to the warmest section near the front of the refrigerator then to the air return air return 28 located at the bottom of the evaporator 20. This improves the air flow underneath the food pans 26*a-n*, as compared to the prior art evaporator 40 shown in FIG. 5 that blows the refrigerated air straight up and the prior art evaporator 42 shown in FIG. 6 that blows the refrigerated air straight out. In addition, because the air flow exiting the fans is not directed toward an obstruction, such as the top of the refrigerator chest 12 (as in FIG. 5) or toward the back of the drawers 14*a-b* (as in FIG. 6), there is less air resistance and turbulence in the air flow. Improving the air circulation in this manner results in more effective and efficient refrigeration, and also a allows greater volume of air to be circulated through the refrigerator.

Of course, the same benefits occur in a refrigerator with doors and shelves, or other types of internal storage bins, rather than drawers. In addition, the evaporator 20 may use any suitable type of refrigeration technology and may have any size, air flow capacity, number of fans, number of refrigeration units and other features suited to the particular application. Likewise, the sandwich-top refrigerator 10 may include any number and organization of doors, drawers, shelves, food pans and other features as suited to the particular application. The evaporator 20 may also be used in other types of refrigerators, such as food pan refrigerators for salads, seafood, ice cream, condiments, and so forth. It should be understood that the foregoing relates only to the exemplary embodiments of the invention, and that changes may be made therein without departing from the spirit and scope of the invention as defined by the following claims.

The invention claimed is:

1. A food pan refrigerator, comprising:

a refrigerator chest having an top surface;

a plurality of food pans set into the top surface of the refrigerator chest;

one or more drawers or shelves located in the refrigerator chest under the food pans;

an evaporator cabinet comprising an angled fan housing located inside the refrigerator chest;

one or more refrigeration units located within the evaporator cabinet;

one or more fans supported by the angled fan housing of the evaporator cabinet and positioned to deliver cooled air from the refrigeration units into a space between the drawers or shelves and the pans and across the food pans to cool the food pans.

2. The refrigerator chest of claim 1, further comprising an air return near the bottom of the evaporator cabinet to receive air emitted by the fans after the air has been circulated within the refrigerator chest.

3. The refrigerator of claim 2, wherein the number of fans is three.

4. The refrigerator of claim 2, wherein the number of refrigeration units is three.

* * * * *